US006888111B1

(12) United States Patent
Tobin

(10) Patent No.: US 6,888,111 B1
(45) Date of Patent: May 3, 2005

(54) Q-HEAT WARM-UPS

(76) Inventor: Luree Tobin, 928 W. 53rd St., Los Angeles, CA (US) 90037

( * ) Notice: Subject to any disclaimer, the term of this patent is extended or adjusted under 35 U.S.C. 154(b) by 0 days.

(21) Appl. No.: 10/626,395

(22) Filed: Jul. 23, 2003

Related U.S. Application Data

(60) Provisional application No. 60/397,691, filed on Jul. 23, 2002.

(51) Int. Cl.[7] ..... H05B 3/54

(52) U.S. Cl. ..... 219/528; 219/211; 219/545; 600/591

(58) Field of Search ..... 219/211, 527, 219/533, 538, 542, 544, 548, 549, 545, 552; 2/78.3, 78.4, 79, 92, 95, 102, 94, 252; 607/108; 600/591; 602/7

(56) References Cited

U.S. PATENT DOCUMENTS

| | | | | | |
|---|---|---|---|---|---|
| 3,729,613 | A | * | 4/1973 | Deloire et al. | 219/211 |
| 3,748,436 | A | * | 7/1973 | Cossaboom | 219/211 |
| 4,533,821 | A | * | 8/1985 | Sato | 219/545 |
| 4,798,933 | A | | 1/1989 | Annovi | |
| 5,101,515 | A | * | 4/1992 | Holt et al. | 2/94 |
| 5,148,002 | A | | 9/1992 | Kuo | |
| 5,866,881 | A | * | 2/1999 | Jones, III | 219/527 |
| 5,891,189 | A | * | 4/1999 | Payne, Jr. | 607/108 |
| 5,913,834 | A | * | 6/1999 | Francais | 600/591 |
| 5,973,602 | A | * | 10/1999 | Cole et al. | 340/584 |
| 6,049,062 | A | | 4/2000 | Jones | |
| 6,329,638 | B1 | * | 12/2001 | Bloodworth | 219/211 |
| 6,439,942 | B1 | * | 8/2002 | Pillai et al. | 441/106 |
| 6,649,873 | B1 | * | 11/2003 | Cintron et al. | 219/211 |
| 6,710,312 | B2 | * | 3/2004 | Bieker et al. | 219/528 |
| 2001/0027282 | A1 | * | 10/2001 | Baugh | 602/7 |
| 2002/0078492 | A1 | * | 6/2002 | Gough et al. | 2/252 |

* cited by examiner

*Primary Examiner*—Robin O. Evans
*Assistant Examiner*—L Fastovsky
(74) *Attorney, Agent, or Firm*—Matthew J. Peirce

(57) ABSTRACT

An apparatus for use with a variety of clothes is disclosed. The apparatus is an elastic band with a plurality of internal heating elements that is incorporated into various items of clothing, with a user having the capability of turning on the elastic band to different heating levels. The elastic band is heated by at least one battery located within an incorporated battery compartment.

4 Claims, 2 Drawing Sheets

Q-HEAT WARM-UPS

This application claims the benefit of U.S. provisional application 60/397,691 filed Jul. 23, 2002.

I. BACKGROUND OF THE INVENTION

The present invention concerns that of a new and improved apparatus for use with a variety of clothes.

II. DESCRIPTION OF THE PRIOR ART

U.S. Pat. No. 6,049,062, issued to Jones, discloses a heated garment located within the liner, powered by a rechargeable battery.

U.S. Pat. No. 5,148,002, issued to Kuo, discloses a garment with a detachable heating unit for use during athletic facilities.

U.S. Pat. No. 4,798,933, issued to Annovi, discloses a battery-powered ski boot heating device.

III. SUMMARY OF THE INVENTION

The present invention concerns that of a new and improved apparatus for use with a variety of clothes. The apparatus is an elastic band with a plurality of internal heating elements that is incorporated into various items of clothing, with a user having the capability of turning on the elastic band to different heating levels. The elastic band is heated by at least one battery located within an incorporated battery compartment.

There has thus been outlined, rather broadly, the more important features of an item of clothing with an attached heating element communications stitching needle that the detailed description thereof that follows may be better understood and in order that the present contribution to the art may be better appreciated. There are, of course, additional features of the item of clothing with an attached heating element that will be described hereinafter and which will form the subject matter of the claims appended hereto.

In this respect, before explaining at least one embodiment of the item of clothing with an attached heating element in detail, it is to be understood that the item of clothing with an attached heating element is not limited in its application to the details of construction and to the arrangements of the components set forth in the following description or illustrated in the drawings. The item of clothing with an attached heating element is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present item of clothing with an attached heating element. It is important, therefore, that the claims be regarded as including such equivalent constructions insofar as they do not depart from the spirit and scope of the present invention.

It is therefore an object of the present invention to provide an item of clothing with an attached heating element which has all of the advantages of the prior art and none of the disadvantages.

It is another object of the present invention to provide an item of clothing with an attached heating element which may be easily and efficiently manufactured and marketed.

It is another object of the present invention to provide an item of clothing with an attached heating element which is of durable and reliable construction.

It is yet another object of the present invention to provide an item of clothing with an attached heating element which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Priority is hereby claimed to application 60/397,691, filed on Jul. 23, 2002.

Figure 1:
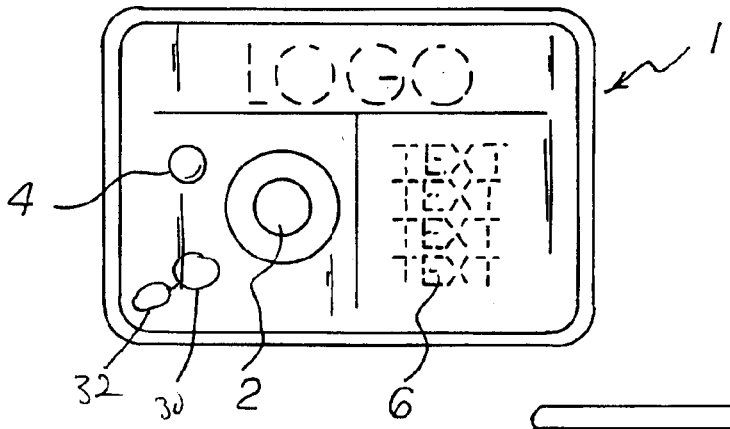
FIG. 1 shows a front view of a patch used with the present invention.

FIG. 1 shows a front view of a patch 1 used with the present invention. Patch 1 has two surfaces, a front surface and a rear surface, and is fabricated from cloth or a similar substance and has front-mounted on/off button 2, power light 4, and operating instructions 6. Patch 1 is preferably sewn onto an elastic band 16 that is used with the present invention.

On/off button 2 is used to turn the power to the present invention on or off. In addition, on/off button 2 is used to turn the present invention to different heating levels, including low, medium, and high. By briefly depressing the on/off button 2, an audio element 30 incorporated into patch 1 and connected to the electronics of the present invention emits one beep through front-mounted speaker 32 if the present invention is on "low," two beeps if the present invention is on "medium," and three beeps if the present invention is on "high." The user can change the power level by merely pressing the button 2, as it will cycle through all three levels. Once it has cycled through all three levels, then it will turn off once pressed again.

Power light 4 is an indicator to show current battery strength to a user. Power light 4 is preferably green if battery strength is good, orange if battery strength is medium or satisfactory, and red if the battery needs to be recharged or replaced.

Figure 2:
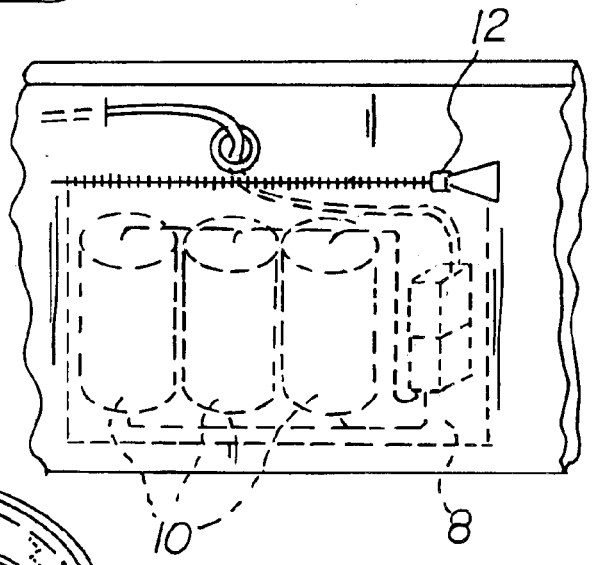
FIG. 2 shows a perspective close-up view of a battery compartment and enclosed batteries used with the present invention.

FIG. 2 shows a perspective close-up view of a battery compartment 8 and enclosed batteries 10 used with the present invention. At least one battery 10 needs to be present and provides power to the present invention. Battery 10, once enclosed in battery compartment 8, is removably enclosed within battery compartment 8 by zipper 12. Battery compartment 8 is incorporated into the elastic band 16.

Figure 3:
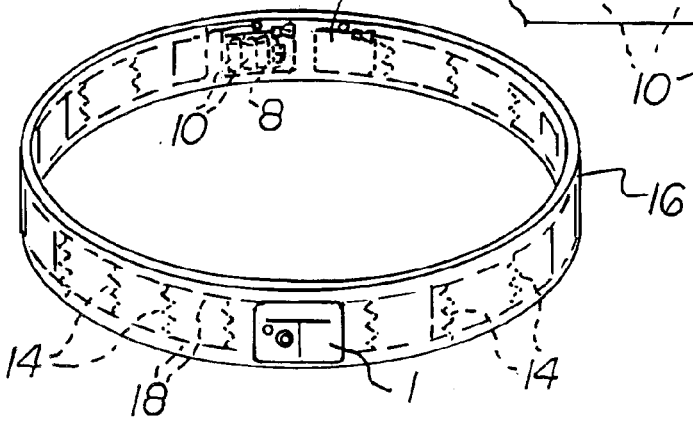
FIG. 3 shows the present invention incorporated into an elastic belt.

FIG. 3 shows the present invention incorporated into an elastic band 16, which has two surfaces, an inner surface and an outer surface. Within elastic band 16 is a plurality of heating elements 14 that are hooked up by a plurality of electrical connections 18 to battery compartment 8 and battery 10. The rear side of patch 1 is sewn onto elastic band 16 and is electronically connected to battery compartment 8 and battery 10.

In FIG. 3, a second battery compartment 9 is shown as being available but not in use. In its preferred form, the present invention has available the second battery compartment 9 to allow a user the option of "weight balancing" the batteries 10 used with the present invention. It would not be a requirement to use second battery compartment 9, but at the very least, is a possible consideration if a user is wearing clothing with the present invention incorporated and did not want to feel off-balance.

Figure 4:
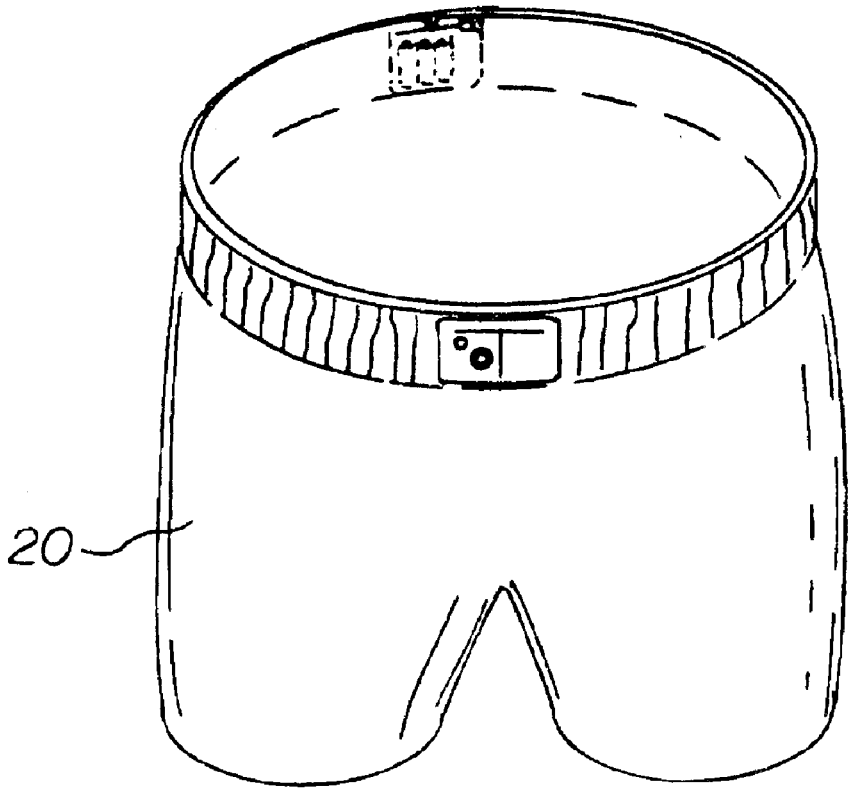
FIGS. 4 and 5 show various applications for the present invention.
Figure 5:
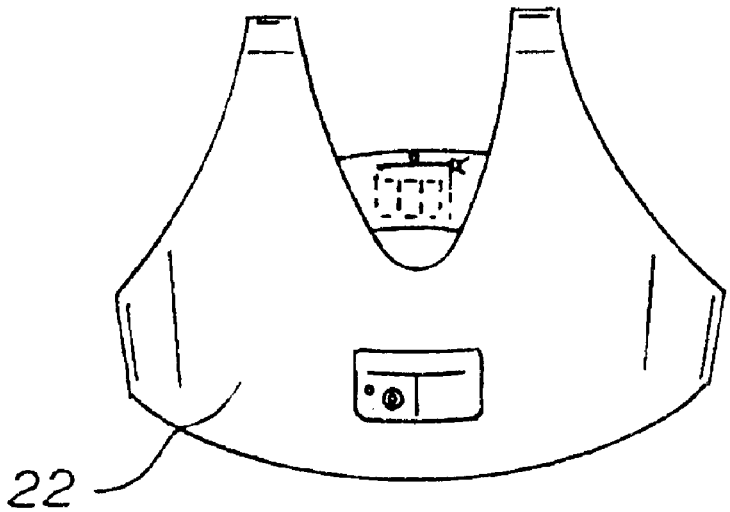

FIGS. 4 and 5 show various applications for the present invention. Elastic band 16 is shown being incorporated into a pair of shorts 20 and a brassiere 22. Other possible uses for the present invention are for use within a shirt, jacket, and a variety of other uses in commonly worn items of clothing.

What I claim as my invention is:

1. A heating element for providing heat to an individual's body in combination with an item of clothing, the heating element comprising:

(a) an elastic band having two surfaces, an inner surface and an outer surface, (b) a first battery compartment incorporated into the elastic band, (c) at least one battery located within the first battery compartment, (d) means for opening and closing the first battery compartment, (e) a plurality of heating elements incorporated into the elastic band, each of the heating elements electronically connected to the battery and the first battery compartment, (f) a patch having two sides, a front side and a rear side, the rear side of the patch mounted on the elastic band, the patch electronically connected to the battery and the first battery compartment, (g) wherein the elastic band is incorporated into the item of clothing (h) an on/off button located on the front surface of the patch, (i) a power light located on the front surface of the patch;

(j) an audio element located within the patch;

(k) a speaker located on the front surface of the patch;

(l) operating instructions located on the front surface of the patch.

2. A heating element according to claim 1 wherein the elastic band further comprises a second battery compartment.

3. A heating element according to claim 2 wherein the elastic band is incorporated into a brassiere.

4. A heating element according to claim 2 wherein the elastic band is incorporated into a pair of shorts.

* * * * *